US006702064B2

(12) United States Patent
Huang

(10) Patent No.: US 6,702,064 B2
(45) Date of Patent: Mar. 9, 2004

(54) LIFTER HAVING TILTABLE SUPPORT RACK ASSEMBLY

(76) Inventor: Chin Piao Huang, P.O. Box 65-45, Taichung (TW), 403

( * ) Notice: Subject to any disclaimer, the term of this patent is extended or adjusted under 35 U.S.C. 154(b) by 59 days.

(21) Appl. No.: 10/116,656

(22) Filed: Apr. 2, 2002

(65) Prior Publication Data

US 2003/0183451 A1 Oct. 2, 2003

(51) Int. Cl.[7] ..... E04G 1/18

(52) U.S. Cl. ..... 182/141; 182/63.1; 182/69.6; 182/148

(58) Field of Search ..... 182/63.1, 69.6, 182/141, 145, 148, 113

(56) References Cited

U.S. PATENT DOCUMENTS 3,765,650 A * 10/1973 Eisenhauer ..... 254/133
4,261,348 A * 4/1981 Hargadon ..... 128/83
4,348,034 A * 9/1982 Welt ..... 280/35
4,640,495 A * 2/1987 Parsons ..... 254/8 B
4,798,266 A * 1/1989 Finkbeiner ..... 187/8.71
4,961,337 A * 10/1990 Henning et al. ..... 72/426
5,533,593 A 7/1996 Huang ..... 182/141
5,636,705 A * 6/1997 St-Germain ..... 182/141
5,934,628 A * 8/1999 Bosnakovic ..... 248/177.1
6,007,259 A * 12/1999 Mori et al. ..... 396/428
6,024,191 A * 2/2000 Backer et al. ..... 182/69.6
6,079,936 A * 6/2000 Watters ..... 414/680
6,443,413 B1 * 9/2002 Hawkins et al. ..... 248/352
6,471,004 B2 * 10/2002 Stringer et al. ..... 182/148

* cited by examiner

*Primary Examiner*—Bruce A. Lev

(57) ABSTRACT

A lifter includes a beam tiltably secured on top of an elevator for supporting an object to be elevated. A base is secured on top of the elevator, and a seat secured to the beam and having one end rotatably secured to the base with a shaft. A bracket and a spring may resiliently support the shaft in the seat. A plate is secured on the seat, a board secured to the beam and rotatably secured on the plate, and a spring biased pin may position the board to the plate at the required angular position. One or more posts and arms may be attached to the beam for supporting the object.

15 Claims, 9 Drawing Sheets

LIFTER HAVING TILTABLE SUPPORT RACK ASSEMBLY

BACKGROUND OF THE INVENTION

1. Field of the Invention

The present invention relates to an elevator or a lifter, and more particularly to a lifter having a tiltable support rack assembly for supporting and moving or elevating workers and/or objects upward to various elevated working positions.

2. Description of the Prior Art

For washing or cleaning the outside walls of buildings, various kinds of scaffolds are required to be set up and attached onto the outside portions of the walls for acting as an aerial ladder and for carrying workers to the desired elevations. These equipments include a complicated configuration having a large number of parts or elements that may not be easily assembled for working purposes and that may not be easily disengaged from each other for storing purposes. In addition, these equipments may not be easily moved elsewhere.

The present applicant had developed another typical elevator or lifter that may be easily moved or carried with the workers, and that may be easily used for elevating the workers to the desired elevations. The mobile lifter has been issued as U.S. Pat. No. 5,533,593 to Huang, and comprises one or more actuators and a support rack for supporting and moving or elevating the workers and/or the objects upward to various elevated working positions. However, the mobile lifter may not be easily used for elevating the heavy planer members, such as the boards, the plates, or the like.

The present invention has arisen to mitigate and/or obviate the afore-described disadvantages of the conventional elevators or lifters.

SUMMARY OF THE INVENTION

The primary objective of the present invention is to provide a lifter including a tiltable support rack assembly for supporting and moving or elevating workers and/or objects upward to various elevated working positions.

The other objective of the present invention is to provide a lifter that may be easily moved from place to place for supporting and elevating workers and/or objects upward to various elevated working positions at different locations.

In accordance with one aspect of the invention, there is provided a lifter comprising an elevator including an upper end, a beam provided above the upper end of the elevator for supporting an object to be elevated, and means for tiltably securing the beam on the upper end of the elevator.

The tiltably securing means includes a base secured on the upper end of the elevator, and a seat for securing to the beam, the seat including a first end rotatably secured to the base with a shaft.

The seat includes two sides each having an oblong hole for slidably receiving the shaft, and means for resiliently supporting the shaft in the seat.

The resiliently supporting means includes a bracket secured to the shaft, and a spring engaged between the bracket and the seat. The bracket includes a column engaged through the spring for retaining the spring in place.

The seat includes a strip secured to the seat and having an orifice formed therein for slidably receiving the column.

The tiltably securing means includes a plate secured on the seat, a board secured to the beam and rotatably secured on the plate, and means for positioning the board to the plate.

The plate includes an upward extending peg engaged through the plate and the board, the positioning means includes a positioning pin attached to the seat and engaged through the plate and the board.

The board includes two or more apertures formed therein, the seat includes means for biasing the positioning pin to engage with the either of the apertures of the board.

A device is further provided for locking the seat to the base, and includes a fastener threaded to the second end of the seat and selectively engaging with the base, for selectively locking the seat to the base.

The beam includes at least one passage formed therein, and a post slidably engaged in the passage of the beam, and means for fastening the post to the beam.

The post includes a plurality of orifices formed therein, the fastening means includes a latch pivotally secured to the beam and having a stud provided on a first end thereof, and means for biasing the stud to engage into either of the orifices of the post.

The beam includes at least one arm rotatably secured to a first side thereof, and a spring blade secured in the beam and engaged with the arm for retaining the arm between a first position perpendicular to the beam and a second position parallel to the beam.

A retaining member may rotatably secured to the post and the arm, and including a non-circular bar, and a coupler secured to the post and the arm and having a depression formed therein for receiving the non-circular bar.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
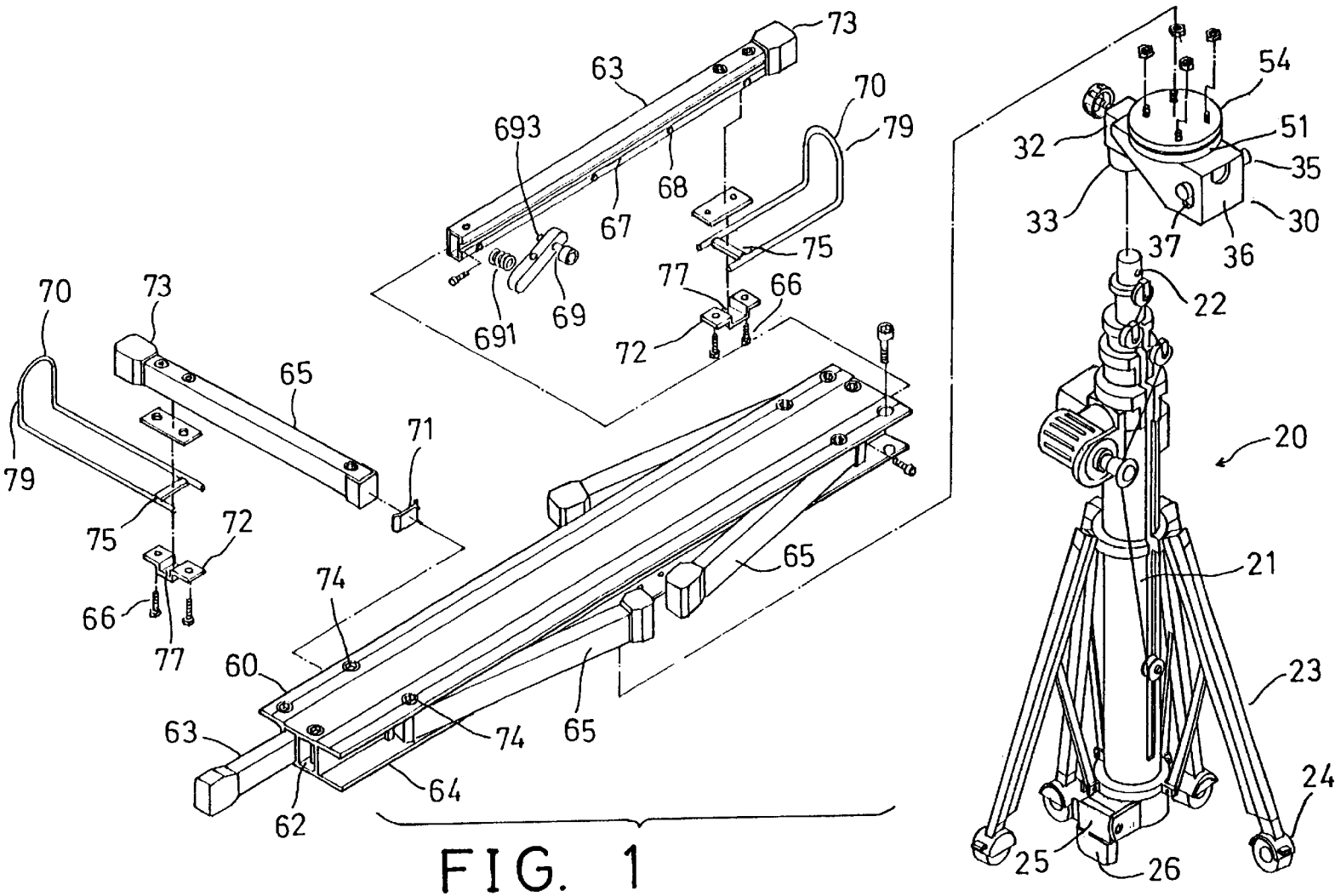
FIG. 1 is a partial exploded view of a lifter in accordance with the present invention.

Referring to the drawings, and initially to FIG. 1, an elevator or a lifter in accordance with the present invention comprises a mobile lifter member or an elevator 20 including a telescopic device 21 extended upward and retractable, and including three or more legs 23 pivotally secured thereto and openable to an outward working position as shown in FIG. 1. The legs 23 each includes a wheel 24 attached thereto for allowing the elevator 20 to be easily moved to the other positions. One example of the elevators 20 has been disclosed in U.S. Pat. No. 5,533,593 to Huang, which is taken as a reference for the present invention. The elevator 20 includes an extension 25 secured to the bottom and having a pad 26 selectively rotatable downward to engage with the ground, for stably positioning the elevator 20 at the selected or required position.

As shown in FIGS. 1–5, an adjustable support device 30 includes a base 32 having a hub 33 extended downward therefrom for engaging onto an upper rod 22 of the elevator 20. A fastener 34 may be engaged through the hub 33 and engaged with the upper rod 22 of the elevator 20 for detachably securing the hub 33 of the base 32 to the rod 22 of the elevator 20. The base 32 includes one or more barrels 320 formed or provided on one end thereof for receiving a shaft 35 therein. A seat 36 includes a chamber 42 formed therein for receiving the base 32, and includes a pair of oblong holes 37 formed in the sides of one end thereof for slidably receiving the shaft 35.

A strip 41 is secured in the bottom of the chamber 42 of the seat 36 with one or more fasteners 43, and includes an orifice 46 formed in the middle portion thereof. A bracket 38 includes a space 381 formed between a pair of flaps 380 for receiving the shaft 35. The flaps 380 each includes an aperture 381 formed therein for receiving a fastener 384 which may be engaged or secured to a hole 351 of the shaft 35, for securing the shaft 35 to the bracket 38. The bracket 38 includes a column 39 extended downward therefrom and slidably engaged through the orifice 36 of the strip 41. A spring 40 is engaged on the column 39 and engaged between the bracket 38 and the strip 41 for resiliently supporting the bracket 38 and the shaft 35 within the chamber 42 of the seat 36.

A plate, such as a disc-shaped plate 51 is secured onto the seat 36 with fasteners or by welding processes, and includes a peripheral skirt 511 extended downward therefrom and having a notch 52 formed therein for receiving a portion of the seat 36. The seat 36 includes a peg 56 extended upward therefrom for engaging through a hole 513 of the plate 51 and for further solidly securing the plate 51 to the seat 36. A positioning pin 531 is detachably or resiliently secured to the seat 36 with a spring 53, and engageable through an orifice 514 of the plate 51 for further positioning the plate 51 to the seat 36.

A board 54 includes a hole 57 formed in the center portion thereof for rotatably receiving the peg 56, and includes one or more apertures 55 formed in the peripheral portion thereof for selectively receiving the positioning pin 531 and for positioning the board 54 to the plate 51 at the selected angular positions. A retaining ring 58 may be engaged onto the peg 56 and engaged with the board 54 for rotatably securing the board 54 to the plate 51. The board 54 includes one or more fasteners 59 extended upward therefrom, for securing a beam 60 thereon (FIGS. 2, 5, 6), and for supporting the object 80 on the beam 60 and to be elevated by the elevator 20.

For example, the spring 53 is engaged between two ears 363, 364 of the seat 36, and has one end secured to the positioning pin 531 for biasing the positioning pin 531 upward through the ear 364 and for biasing the positioning pin 531 to engage through the orifice 514 of the plate 51, and to selectively engage through either of the apertures 55 of the board 54. The positioning pin 531 may be pulled away from the board 54 against the spring 53 with a ring 533, for allowing the board 54 to be rotated and adjusted relative to the plate 51. The positioning pin 531 may be biased by the spring 53 to engage into the other aperture 55 of the board 54 when the aperture 55 of the board 54 is aligned with the positioning pin 531.

Figure 7:
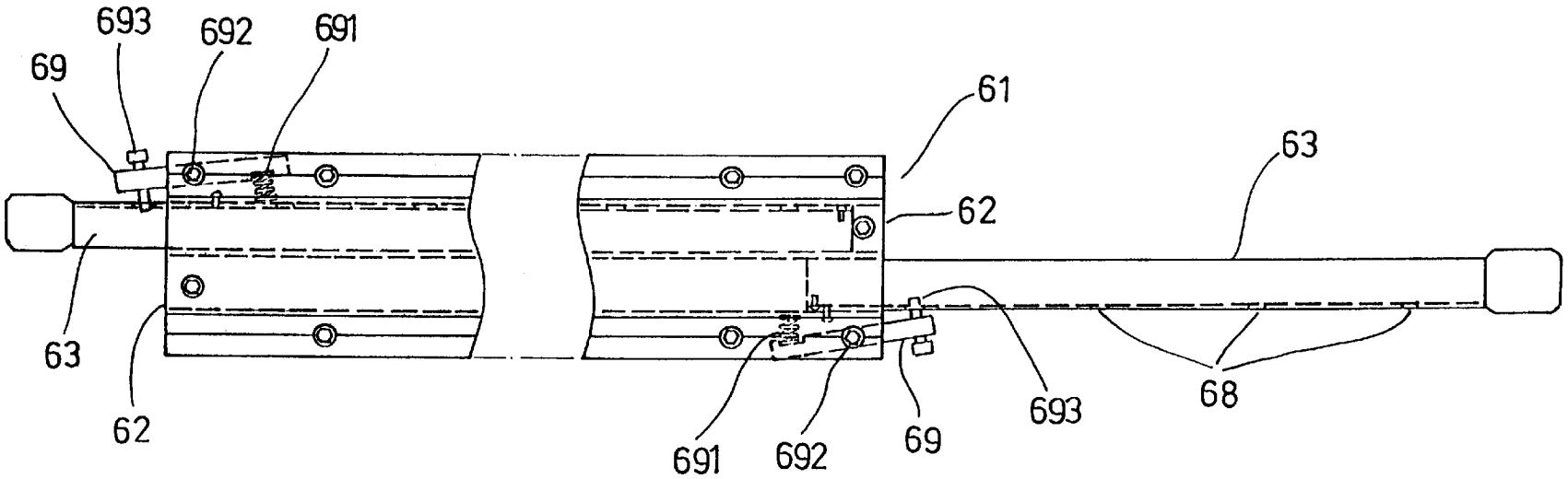
FIGS. 7 and 8 are top plan schematic views illustrating the operation of the tiltable support rack assembly for the lifter.

The beam 60 includes a pair of passages 62 formed therein for slidably receiving a pair of posts 63 which may be moved or extended outward of the beam 60 in opposite directions (FIGS. 2, 7); and includes two side grooves 64 formed therein. The posts 63 each includes a slot 67 formed therein, and each includes one or more orifices 68 formed therein. Two latches 69 each has a middle portion rotatably secured in the grooves 64 of the beam 60 with a pivot axle 692, and each has a lock stud 693 secured or threaded to one end thereof. A spring 691 is engaged with the other end of the latch 69 for biasing the lock stud 693 to engage into either of the orifices 68 of the posts 63, and for detachably securing the posts 63 to the beam 60, and for allowing the posts 63 to be extended and adjusted inward and outward relative to the beam 60.

Figure 2:
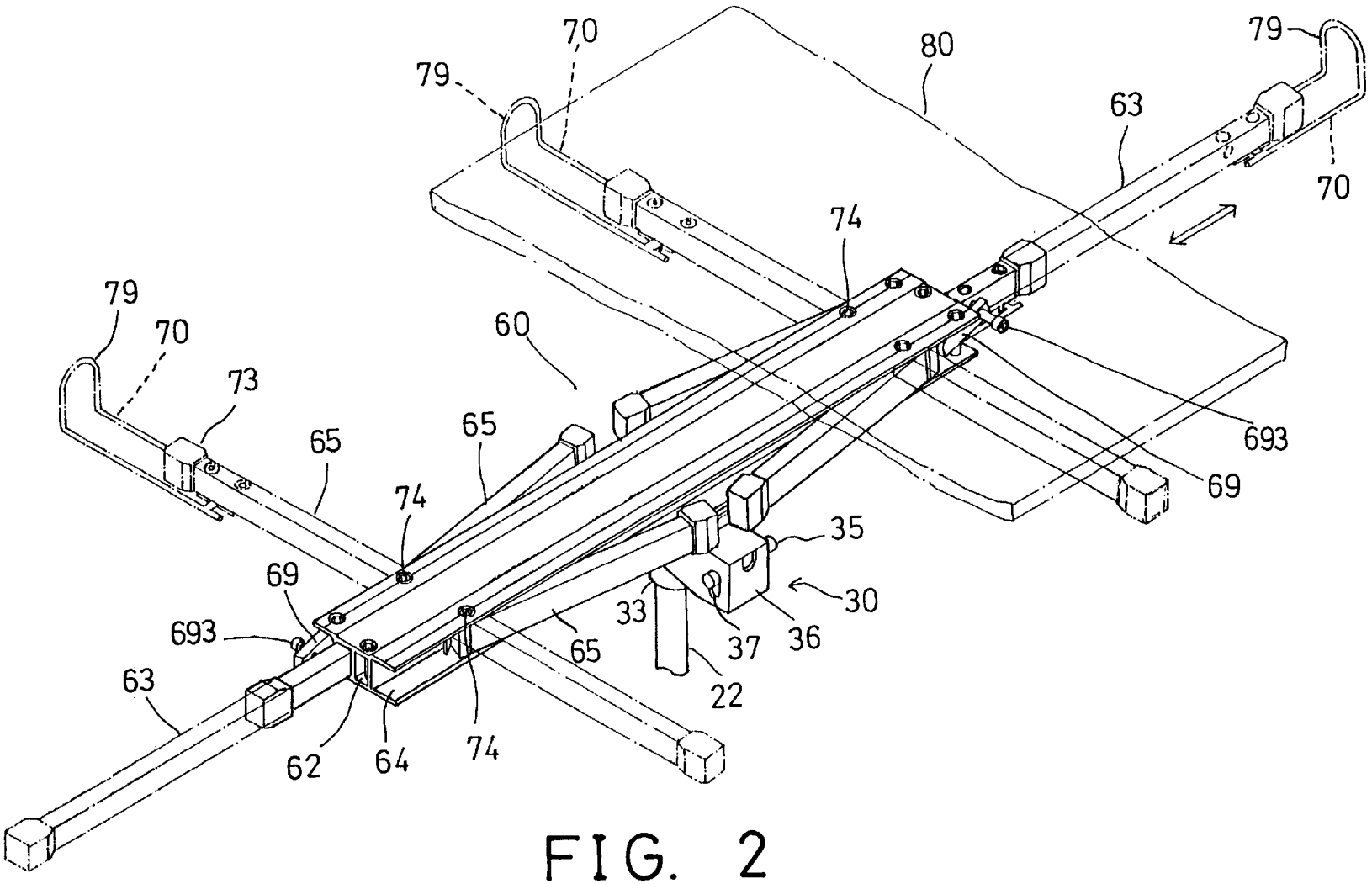
FIG. 2 is a partial perspective view illustrating a tiltable support rack assembly for the lifter.
Figure 8:
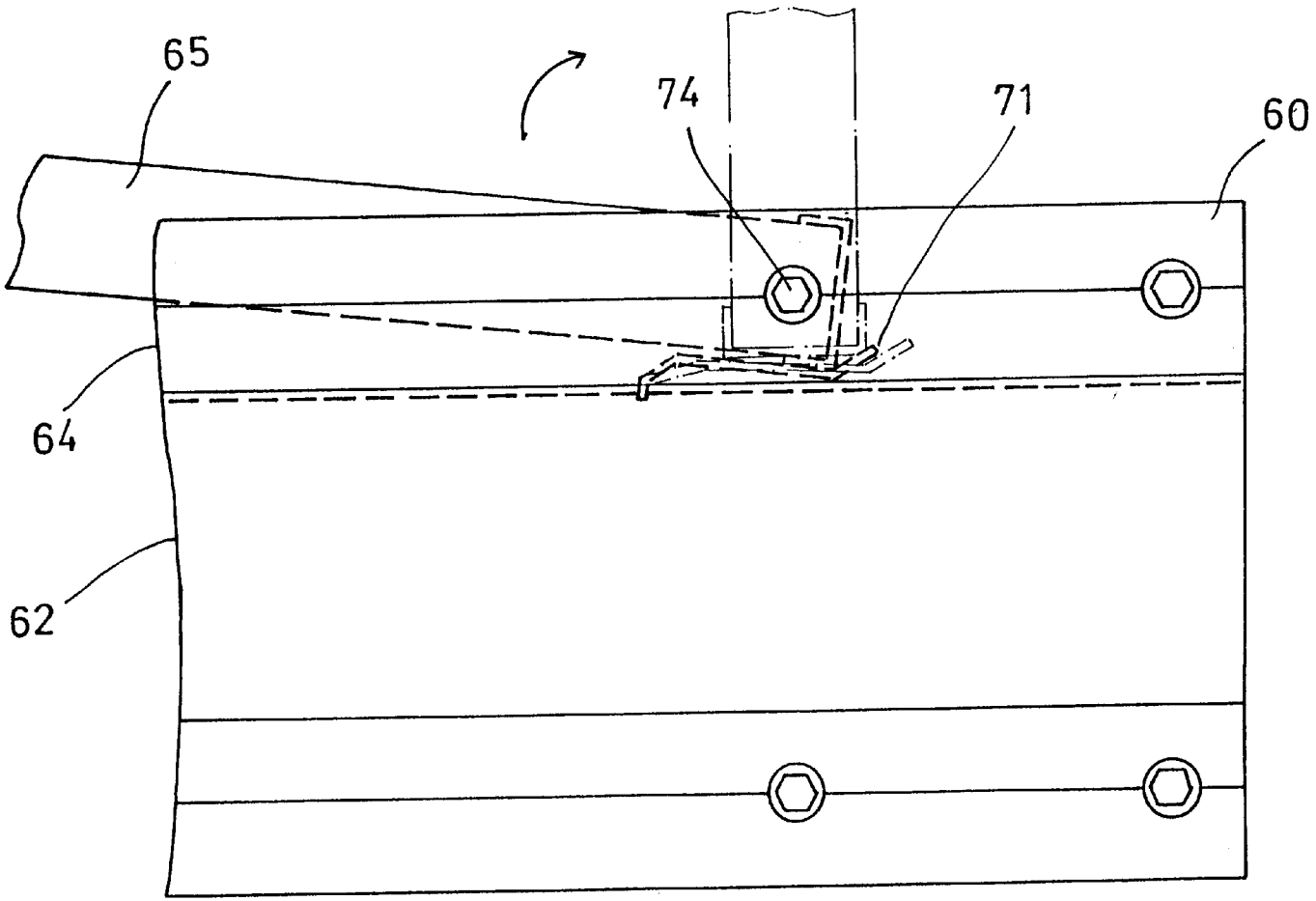

As shown in FIGS. 1, 2 and 8, two pairs or four arms 65 each has one end rotatably rotatably secured in the grooves 64 of the beam 60 with a pivot pole 74, and each has a pad 73 secured to the other end for safely supporting the object 80. Four spring blades 71 are secured in the beam 60 and engageable with the ends of the arms 65 (FIG. 8), for positioning the arms 65 at either the outward working position that is perpendicular to the beam 60 or at the inward storing position that is received in the grooves 64 of the beam 60.

Figure 10:
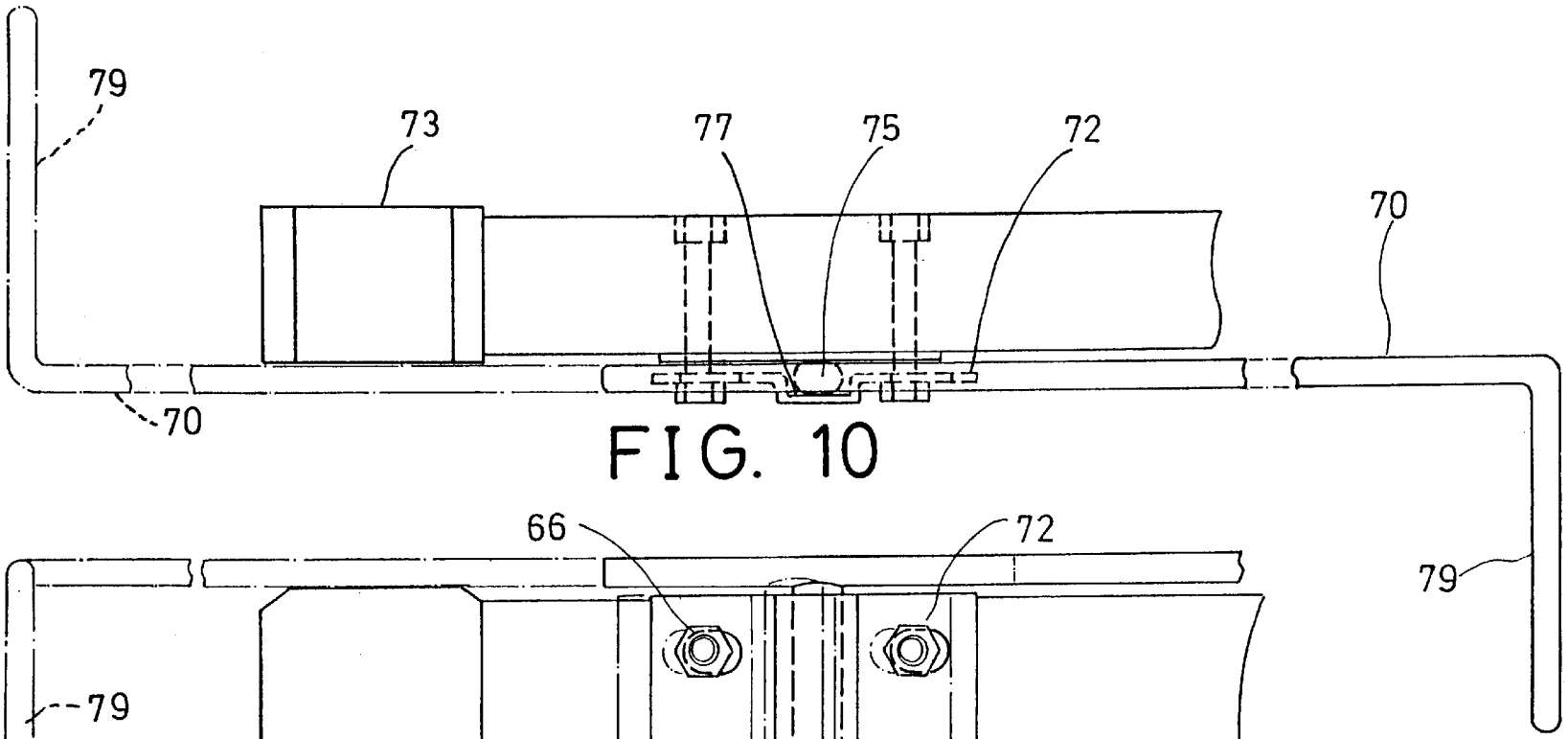
FIG. 10 is a partial side view illustrating the attachment of the end retaining member to the tiltable support rack assembly for the lifter.
Figure 9:
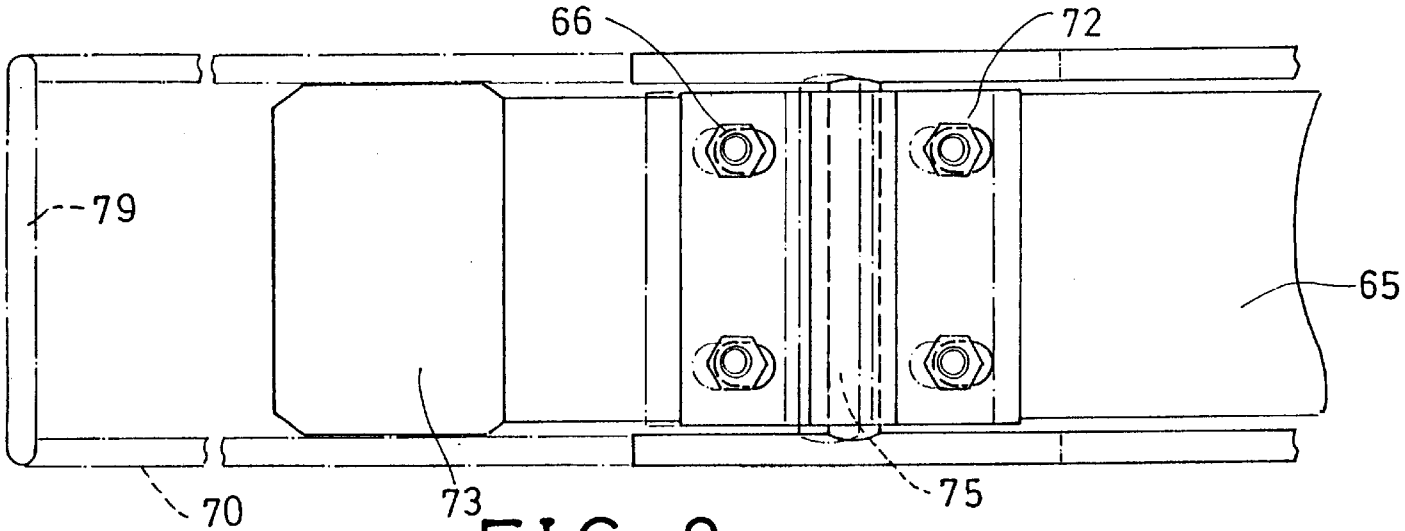
FIG. 9 is a partial top view illustrating the attachment of an end retaining member to the tiltable support rack assembly for the lifter.

One or more retaining members 70 are hook-shaped and each includes an oblong or rectangular or non-circular bar 75 secured or provided in one end thereof, and/or each includes a hook 79 provided on the other end thereof for engaging with the object 80 (FIG. 2). A coupler 72 includes a depression 77 for receiving the non-circular bar 75 therein, and is secured to the respective arms 65 or posts 63 with fasteners 66. The non-circular bar 75 may be retained in the depression 77 of the coupler 72, but may be rotated relative to the coupler 72 for 180 degrees, for allowing the retaining members 70 to be rotated relative to the arms 65 or the posts 63 to an outward or upward working position as shown in FIG. 2 or as shown in dotted lines in FIGS. 9 and 10, or to an inward or downward storing position as shown in solid lines in FIG. 10.

Figure 3:
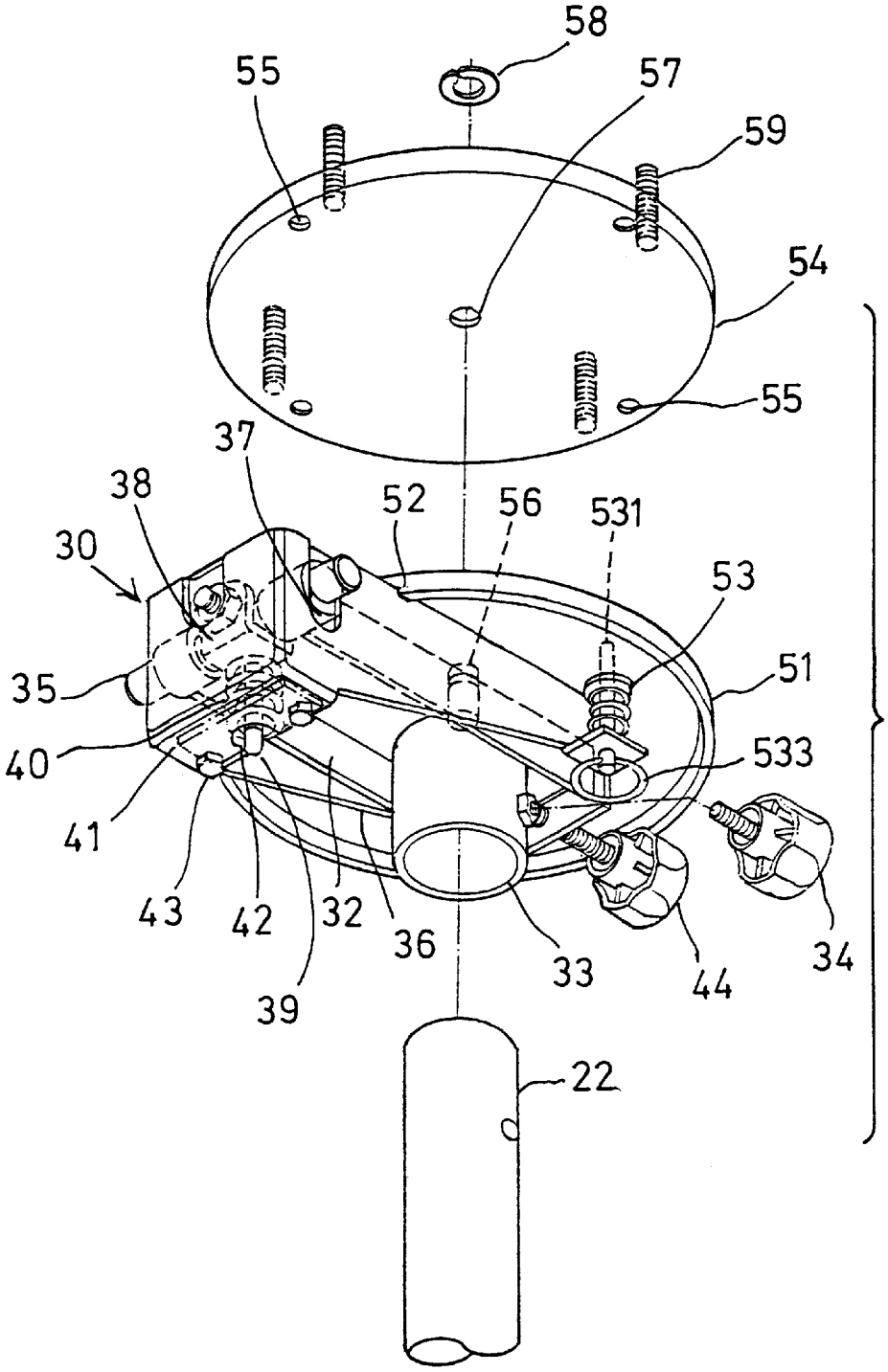
FIGS. 3 and 4 are partial exploded views illustrating a tiltable support device of the lifter for supporting the racks.
Figure 4:
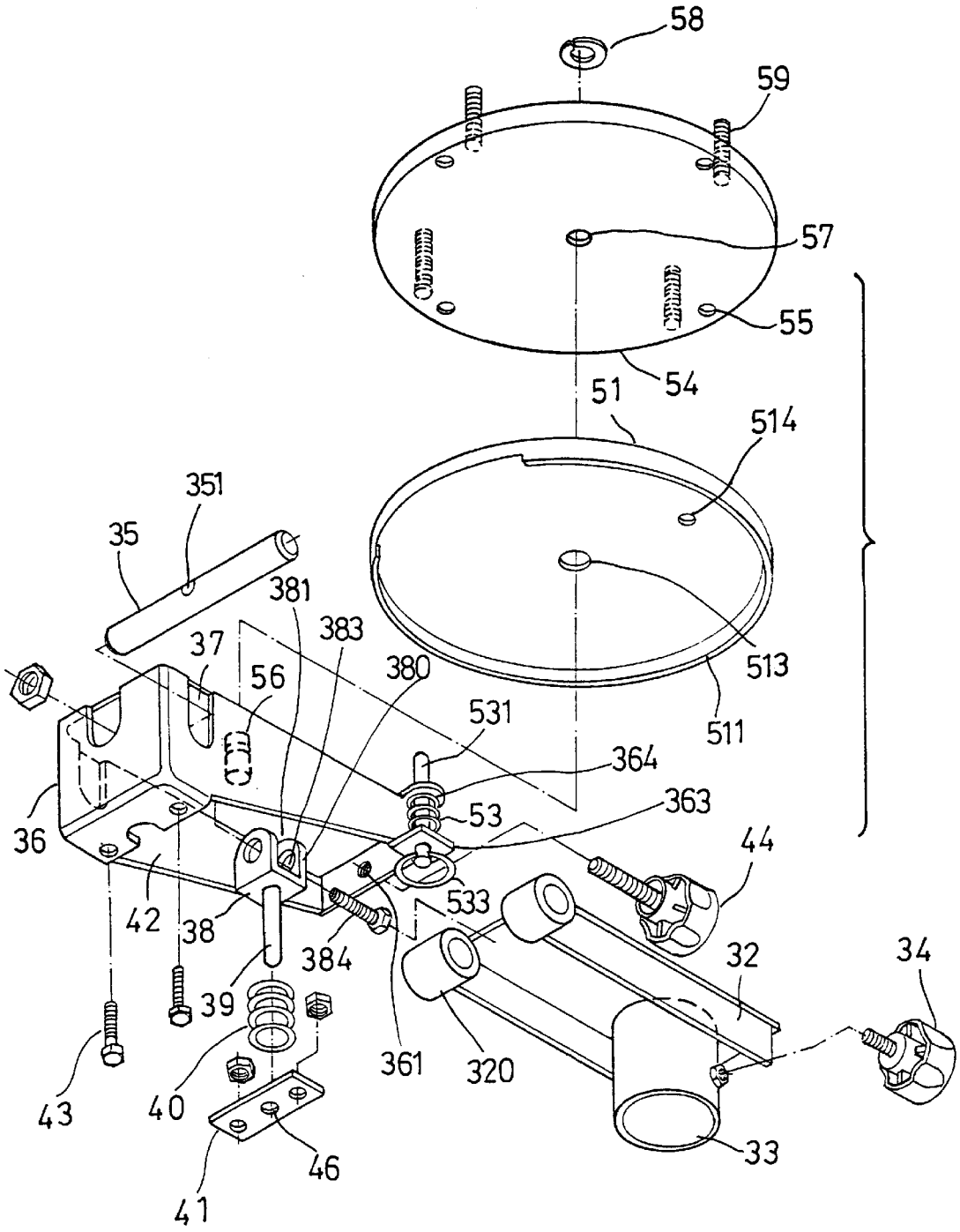
Figure 6:
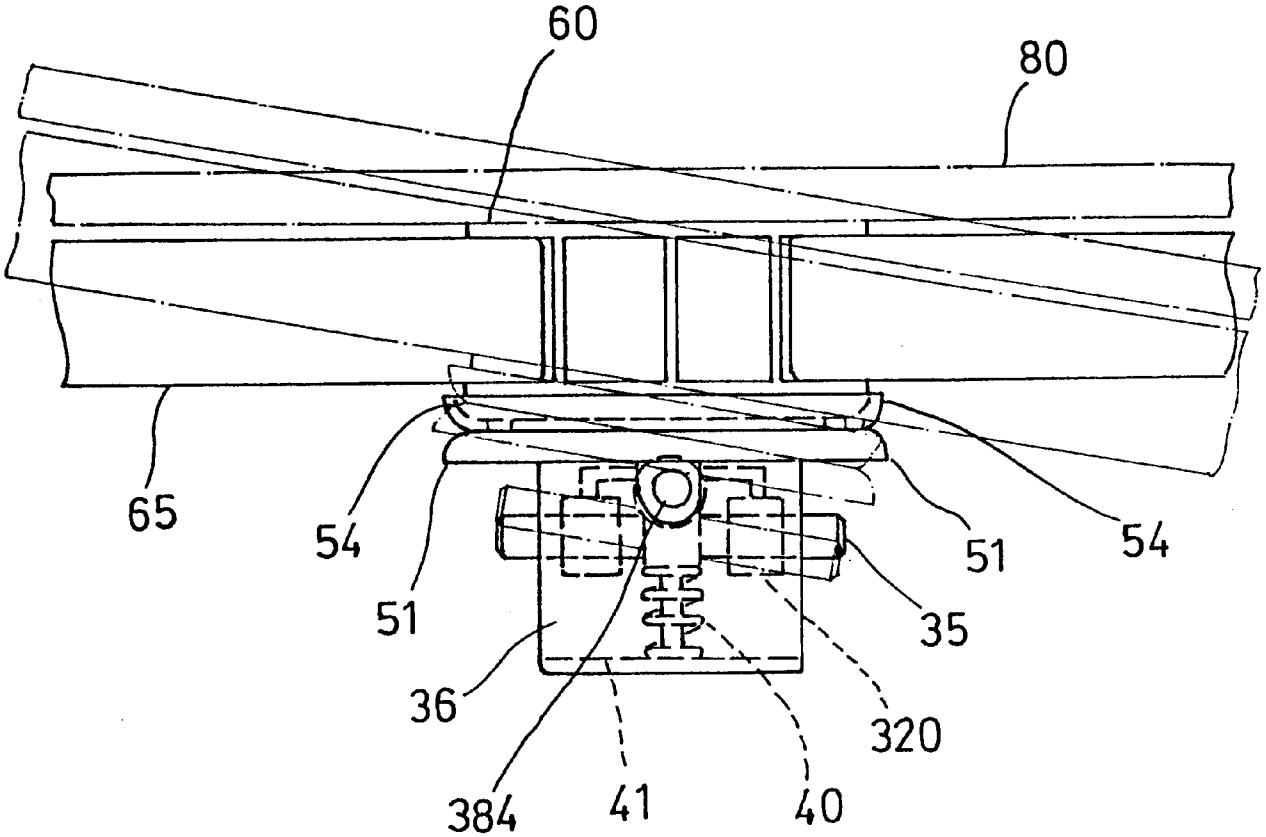
FIG. 6 is a partial end view illustrating the operation of the tiltable support rack assembly for the lifter.

In operation, as shown in FIGS. 3, 6, the shaft 35 is resiliently supported in the chamber 42 of the seat 36 with the spring 40 and the bracket 38, and the ends of the shaft 35 are slidably received in the oblong holes 37 of the seat 36, such that the seat 36 and thus the plate 51 and the board 54 may be slightly moved or rotated relative to the fastener 384 or may be vibrated relative to the seat 36. The vibrating movement of the shaft 35 relative to the seat 36 may be limited by the sliding movement of the ends of the shaft 35 relative to the oblong holes 37 of the seat 36.

Figure 5:
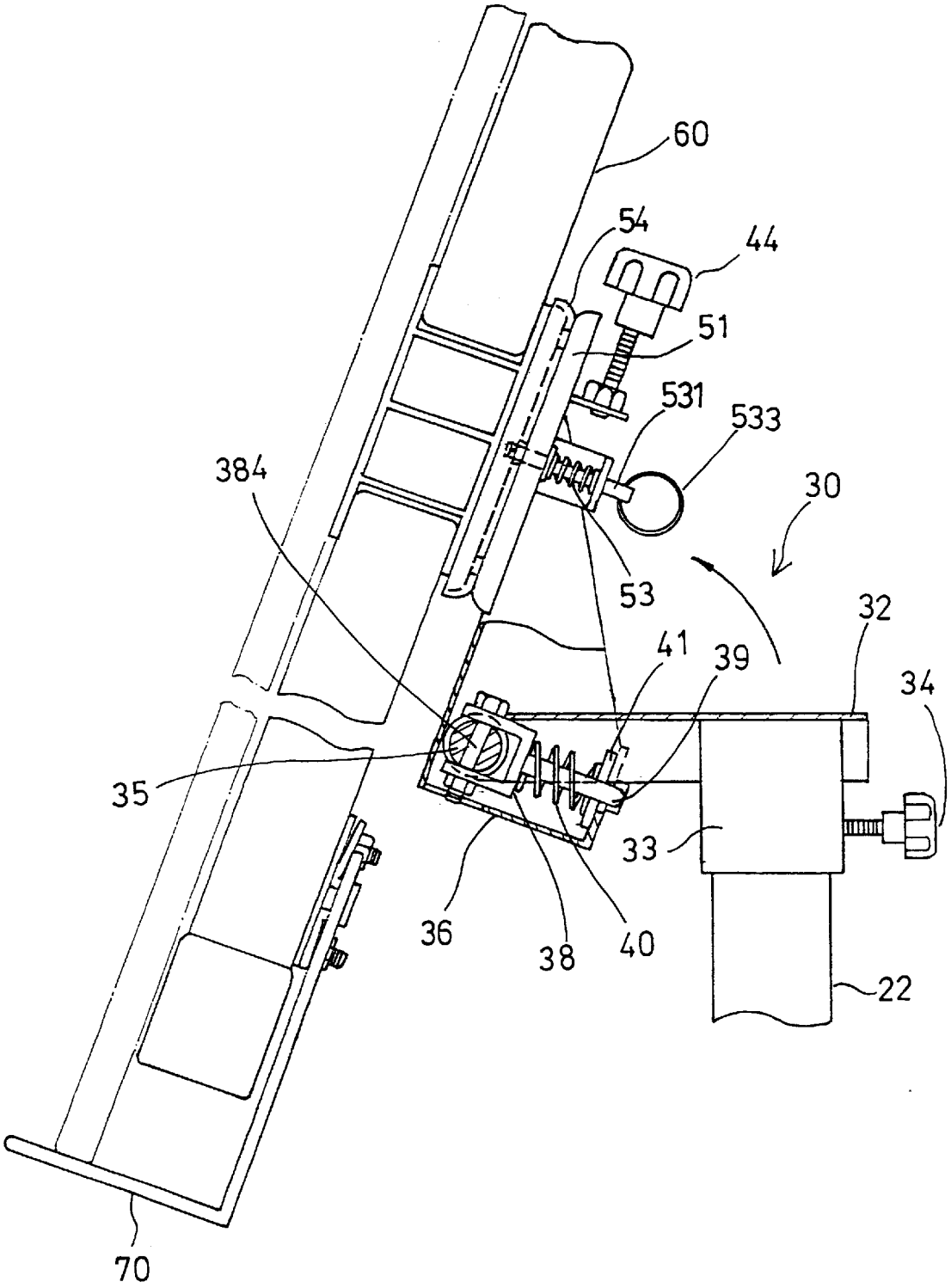
FIG. 5 is a side view of the lifter, in which a portion of the tiltable support rack assembly of the lifter is cut off for illustrating the inner structure of the tiltable support rack assembly for the lifter.

As shown in FIG. 2, the object 80 may be elevated by the elevator 20 to the required height. As shown in FIG. 5, the seat 36 and the plate 51 and the board 54 and the beam 60 may be rotated relative to the base 32 about the shaft 35, for allowing the objected 80 to be tilted and moved or easily disengaged from beam 60. A fastener 44 may be threaded to a screw hole 361 (FIG. 4) that is formed in the other end of the seat 36 opposite to the shaft 35, and may be engaged with the base 32 (FIG. 3) for securing the seat 36 to the base 32 and for preventing the seat 36 from rotating relative to the base 32.

Accordingly, the lifter in accordance with the present invention includes a tiltable support rack assembly for supporting and moving or elevating workers and/or objects upward to various elevated working positions, and the lifter may be easily moved from place to place for supporting and elevating workers and/or objects upward to various elevated working positions at different locations.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A lifter comprising:

an elevator including an upper end, a beam provided above said upper end of said elevator for supporting an object to be elevated, said beam including at least one arm rotatably secured to a first side thereof, a spring blade secured in said beam and engaged with said at least one arm for retaining said at least one arm between a first position perpendicular to said beam and a second position parallel to said beam, and means for tiltably securing said beam on said upper end of said elevator.

2. The lifter according to claim 1, wherein said tiltably securing means includes a base secured on said upper end of said elevator, and a seat for securing to said beam, said seat includes a first end rotatably secured to said base with a shaft.

3. The lifter according to claim 2 further comprising means for locking said seat to said base.

4. The lifter according to claim 1, wherein said beam includes at least one passage formed therein, and a post slidably engaged in said at least one passage of said beam, and means for fastening said post to said beam.

5. The lifter according to claim 1 further comprising a retaining member rotatably secured to said at least one arm, and including a non-circular bar, and a coupler secured to said at least one arm and having a depression formed therein for receiving said non-circular bar.

6. A lifter comprising:

an elevator including an upper end, a beam provided above said upper end of said elevator for supporting an object to be elevated, and means for tiltably securing said beam on said upper end of said elevator, said tiltably securing means including a base secured on said upper end of said elevator, and a seat for securing to said beam, said seat including a first end rotatably secured to said base with a shaft, and said seat including two sides each having an oblong hole formed therein for slidably receiving said shaft, and means for resiliently supporting said shaft in said seat.

7. The lifter according to claim 6, wherein said resiliently supporting means includes a bracket secured to said shaft, and a spring engaged between said bracket and said seat.

8. The lifter according to claim 7, wherein said bracket includes a column extended therefrom and engaged through said spring for retaining said spring in place.

9. The lifter according to claim 8, wherein said seat includes a strip secured to said seat and having an orifice formed therein for slidably receiving said column.

10. A lifter comprising:

an elevator including an upper end, a beam provided above said upper end of said elevator for supporting an object to be elevated, and means for tiltably securing said beam on said upper end of said elevator, said tiltably securing means including a base secured on said upper end of said elevator, and a seat for securing to said beam, said seat including a first end rotatably secured to said base with a shaft, and said tiltably securing means including a plate secured on said seat, a board secured to said beam and rotatably secured on said plate, and means for positioning said board to said plate.

11. The lifter according to claim 10, wherein said plate includes an upward extending peg engaged through said plate and said board, said positioning means includes a positioning pin attached to said seat and engaged through said plate and said board.

12. The lifter according to claim 11, wherein said board includes a first aperture and at least one second aperture formed therein, said seat includes means for biasing said positioning pin to engage with either of said first and said at least one second apertures of said board.

13. A lifter comprising:

an elevator including an upper end, a beam provided above said upper end of said elevator for supporting an object to be elevated, and means for tiltably securing said beam on said upper end of said elevator, said tiltably securing means including a base secured on said upper end of said elevator, and a seat for securing to said beam, said seat including a first end rotatably secured to said base with a shaft, said seat including a second end, said locking means including a fastener threaded to said second end of said seat and selectively engaging with said base, for selectively locking said seat to said base.

14. A lifter comprising:

an elevator including an upper end, a beam provided above said upper end of said elevator for supporting an object to be elevated, said beam including at least one passage formed therein, means for tiltably securing said beam on said upper end of said elevator, a post slidably engaged in said at least one passage of said beam, said post including a plurality of orifices formed therein, and means for fastening said post to said beam, said fastening means including a latch pivotally secured to said beam and having a stud provided on a first end thereof, and means for biasing said stud to engage into either of said orifices of said post.

15. A lifter comprising:

an elevator including an upper end, a beam provided above said upper end of said elevator for supporting an object to be elevated, said beam including at least one passage formed therein, means for tiltably securing said beam on said upper end of said elevator, a post slidably engaged in said at least one passage of said beam, means for fastening said post to said beam, and a retaining member rotatably secured to said post, and including a non-circular bar, and a coupler secured to said post and having a depression formed therein for receiving said non-circular bar.

* * * * *